US007728803B2

(12) United States Patent
Hu

(10) Patent No.: US 7,728,803 B2
(45) Date of Patent: Jun. 1, 2010

(54) METHOD AND RELATED APPARATUS FOR DRIVING AN LCD MONITOR

(75) Inventor: Yu-Tsung Hu, Changhua County (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 619 days.

(21) Appl. No.: 11/621,997

(22) Filed: Jan. 11, 2007

(65) Prior Publication Data

US 2008/0111835 A1 May 15, 2008

(30) Foreign Application Priority Data

Nov. 13, 2006 (TW) ..... 95141914 A

(51) Int. Cl.
*G09G 3/36* (2006.01)

(52) U.S. Cl. ..... 345/89; 345/690

(58) Field of Classification Search ..... 345/87, 345/690, 89

See application file for complete search history.

(56) References Cited

U.S. PATENT DOCUMENTS

| | | | | |
|---|---|---|---|---|
| 7,142,186 | B2 * | 11/2006 | Lee et al. | 345/89 |
| 2005/0007331 | A1 * | 1/2005 | Yamazaki et al. | 345/92 |
| 2005/0162360 | A1 * | 7/2005 | Ishihara et al. | 345/89 |
| 2005/0200619 | A1 * | 9/2005 | Adachi et al. | 345/204 |
| 2007/0018934 | A1 * | 1/2007 | Kim et al. | 345/98 |

FOREIGN PATENT DOCUMENTS

CN 1379388 A 11/2002

* cited by examiner

*Primary Examiner*—Chanh Nguyen
*Assistant Examiner*—Tsegaye Seyoum
(74) *Attorney, Agent, or Firm*—Winston Hsu

(57) ABSTRACT

A method for driving an LCD monitor includes receiving image data corresponding to a pixel of the LCD monitor, comparing pixel values of a first frame data and a second frame data in the image data, dividing the second frame data into a plurality of sub-frame data when a difference between the first frame data and the second frame is greater than a predetermined value, adjusting pixel values of the sub-frame data according to the pixel value of the second frame data, and sequentially displaying the sub-frame data by the pixel.

18 Claims, 13 Drawing Sheets

METHOD AND RELATED APPARATUS FOR DRIVING AN LCD MONITOR

BACKGROUND OF THE INVENTION

1. Field of the Invention

The present invention relates to a method and related apparatus for driving an LCD monitor, and more particularly, to a method and related apparatus for dynamically determining whether sub-frames are necessary to be inserted and determining gray values of the sub-frames according to a gray value difference between adjacent frames.

2. Description of the Prior Art

The advantages of a liquid crystal display (LCD) include lighter weight, less electrical consumption, and less radiation contamination. Thus, the LCD monitors have been widely applied to various portable information products, such as notebooks, PDAs, etc. In an LCD monitor, incident light produces different polarization or refraction effects when the alignment of liquid crystal molecules is altered. The transmission of the incident light is affected by the liquid crystal molecules, and thus magnitude of the light emitting out of liquid crystal molecules varies. The LCD monitor utilizes the characteristics of the liquid crystal molecules to control the corresponding light transmittance and produces gorgeous images according to different magnitudes of red, blue, and green light.

Please refer to FIG. 1, which illustrates a schematic diagram of a prior art thin film transistor (TFT) LCD monitor 10. The LCD monitor 10 includes an LCD panel 100, a control circuit 102, a data-line-signal output circuit 104, a scan-line-signal output circuit 106, and a voltage generator 108. The LCD panel 100 is constructed by two parallel substrates, and the liquid crystal molecules are filled up between these two substrates. A plurality of data lines 110, a plurality of scan lines 112 that are perpendicular to the data lines 24, and a plurality of TFTs 114 are positioned on one of the substrates. There is a common electrode installed on another substrate, and the voltage generator 108 is electrically connected to the common electrode for outputting a common voltage Vcom via the common electrode. Please note that only four TFTs 114 are shown in FIG. 1 for clarity. Actually, the LCD panel 100 has one TFT 114 installed in each intersection of the data lines 110 and scan lines 112. In other words, the TFTs 28 are arranged in a matrix format on the LCD panel 100. The data lines 110 correspond to different columns, and the scan lines 112 correspond to different rows. The LCD monitor 10 uses a specific column and a specific row to locate the associated TFT 114 that corresponds to a pixel. In addition, the two parallel substrates of the LCD panel 100 filled up with liquid crystal molecules can be considered as an equivalent capacitor 116.

The operation of the prior art LCD monitor 10 is described as follows. When the control circuit 102 receives a horizontal synchronization signal 118 and a vertical synchronization signal 120, the control circuit 102 generates corresponding control signals respectively inputted into the data-line-signal output circuit 104 and the scan-line-signal output circuit 106. The data-line-signal output circuit 104 and the scan-line-signal output circuit 106 then generate input signals to the LCD panel 100 for turning on the corresponding TFTs 114 and changing the alignment of liquid crystal molecules and light transmittance, so that a voltage difference can be kept by the equivalent capacitors 116 and image data 122 can be displayed in the LCD panel 100. For example, the scan-line-signal output circuit 106 outputs a pulse to the scan line 112 for turning on the TFT 114. Therefore, the voltage of the input signal generated by the data-line-signal output circuit 104 is inputted into the equivalent capacitor 116 through the data line 110 and the TFT 114. The voltage difference kept by the equivalent capacitor 116 can then adjust a corresponding gray level of the related pixel through affecting the related alignment of liquid crystal molecules positioned between the two parallel substrates. In addition, the data-line-signal output circuit 104 generates the input signals, and magnitude of each input signal inputted to the data line 110 is corresponding to different gray levels.

Since the physical performance of liquid crystal molecules is similar to a capacitor, the response speed of the liquid crystal molecules may be too slow. In addition, unlike a cathode ray tube (CRT) display applying an impulse-type driving method, an LCD display applying a hold-type driving method has a motion blur phenomenon caused by image edges of a moving subject. In order to reduce the motion blur phenomenon, the prior art provides a black frame insertion technique, or pseudo impulse-type driving technique, to shorten durations of original frames and insert pure black sub-frames or sub-frames with low gray values. In short, the black frame insertion technique inserts a sub-frame with a gray value equal to 0 or a comparative low value between two adjacent frames.

Please refer to FIG. 2 and FIG. 3. FIG. 2 is a schematic diagram of frames of a pixel when performing the prior art black frame insertion technique, and FIG. 3 is a schematic diagram of light intensity generated by the prior art pixel. Shadow areas represent received driving data P0, P1, P2, etc. of the pixel in each frame duration, and the driving data P0, P1, P2, etc. are respectively corresponding to the frame F0, F1, F2, etc. As shown in FIG. 2, gray values of the driving data return to zero (or a comparative low value) before the next driving data is inputted. In such circumstance, variation of the light intensity of the pixel applied the black frame insertion technique is similar to that of a pixel applied the impulse type driving method.

Since the liquid crystal molecules perform as capacitors, the liquid crystal molecules must take time to reach correct gray values when the gray value displayed by the pixel varies. Therefore, although the motion blur phenomenon can be eliminated through the black frame insertion technique, there is a multi-edge effect on edges of the moving subject, especially for a high-contrast image. For example, if a movie shows a bright subject moving in a dark background, the black frame insertion technique can eliminate the motion blur problem in the rear edge of the moving subject. However, in the front edge of the moving subject, the multi-edge effect appears owing to the long response time of the liquid crystal molecules. Similarly, if an animation shows a dark subject moving in a bright background, the black frame insertion technique can eliminate the motion blur problem in the front edge of the moving subject. However, in the rear edge of the moving subject, the multi-edge effect appears owing to the long response time of the liquid crystal molecules.

Therefore, although the prior art black frame insertion technique can eliminate the motion blur problem, there is still the multi-edge effect in an LCD monitor having slow-response liquid crystal molecules. Hence, the image quality of the LCD monitor cannot be enhanced effectively. In addition, as shown in FIG. 3, the pixel displays image data only during half the frame durations, and displays black image with zero gray value during rest frame durations. In other words, the black frame insertion technique shows half the average brightness of original images, and thus affects the image quality.

SUMMARY OF THE INVENTION

It is therefore a primary objective of the claimed invention to provide a method and related apparatus for driving an LCD monitor.

The present invention discloses a method for driving an LCD monitor. The method includes receiving display data corresponding to a pixel of the LCD monitor, comparing gray values of a first frame data and a second frame data in the display data, dividing the second frame data into a plurality of sub-frame data when a gray value difference between the first frame data and the second frame data is greater than a predetermined value, adjusting gray values of the plurality of sub-frame data respectively according to the gray value of the second frame data, and displaying the plurality of sub-frame data by the pixel sequentially.

The present invention further discloses a pixel driving device of an LCD monitor. The pixel driving device includes a reception end for receiving display data corresponding to a pixel of the LCD monitor, a comparison unit coupled to the reception end for comparing gray values of a first frame data and a second frame data in the display data, a division unit coupled to the comparison unit and the reception end for dividing the second frame data into a plurality of sub-frame data when a gray value difference between the first frame data and the second frame data is greater than a predetermined value, an adjustment unit coupled to the division unit and the reception end for adjusting gray values of the plurality of sub-frame data respectively according to the gray value of the second frame data, and an output unit coupled to the adjustment unit for displaying the plurality of sub-frame data by the pixel sequentially.

The present invention further discloses a pixel driving device of an LCD monitor. The pixel driving device includes a reception end for receiving display data corresponding to a pixel of the LCD monitor, a first buffer coupled to the reception end for storing a first frame data in the display data, a logic unit coupled to the first buffer and the reception end for generating a first sub-frame data and a second sub-frame data according to a gray value difference between the first frame data and a second frame data in the display data, a second buffer coupled to the logic unit for storing the second sub-frame data in the display data, and an output unit coupled to the logic unit and the second buffer for displaying the first sub-frame data and the second sub-frame data by the pixel sequentially.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
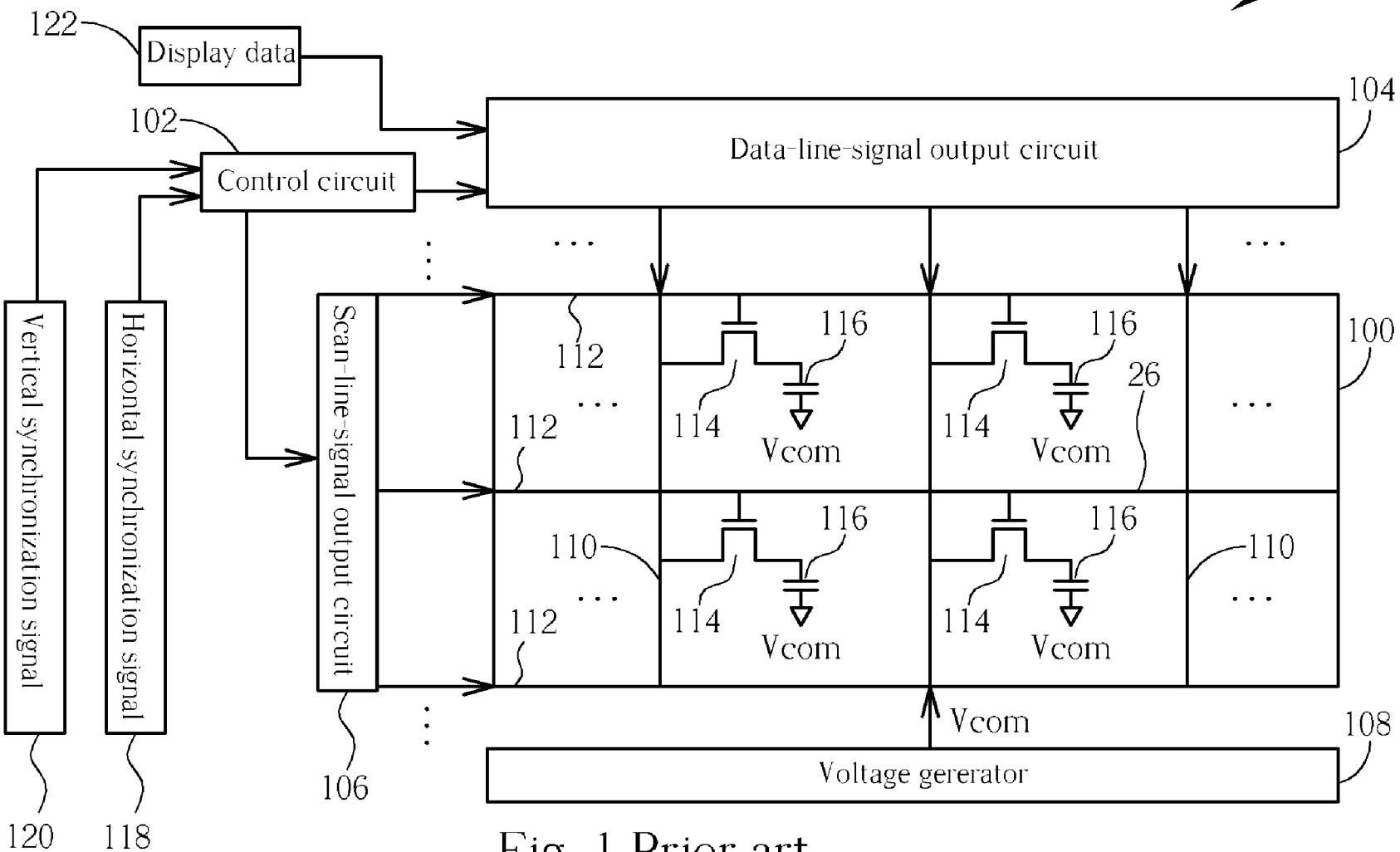
Fig. 1 Prior art
FIG. 1 is a schematic diagram of a prior art TFT LCD monitor.
Figure 2:
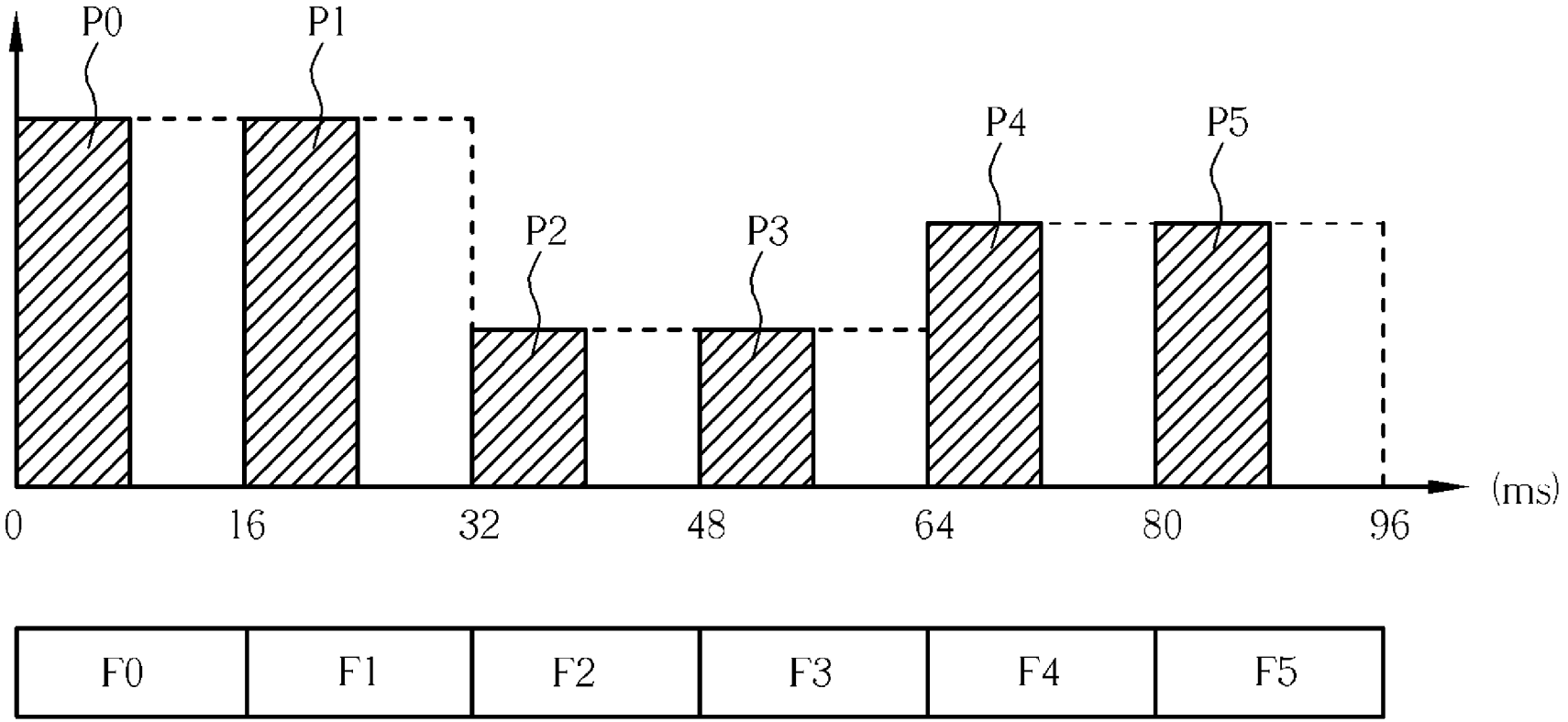
Fig. 2 Prior art
FIG. 2 is a schematic diagram of a prior art pixel realizing a black frame insertion technique.
Figure 3:
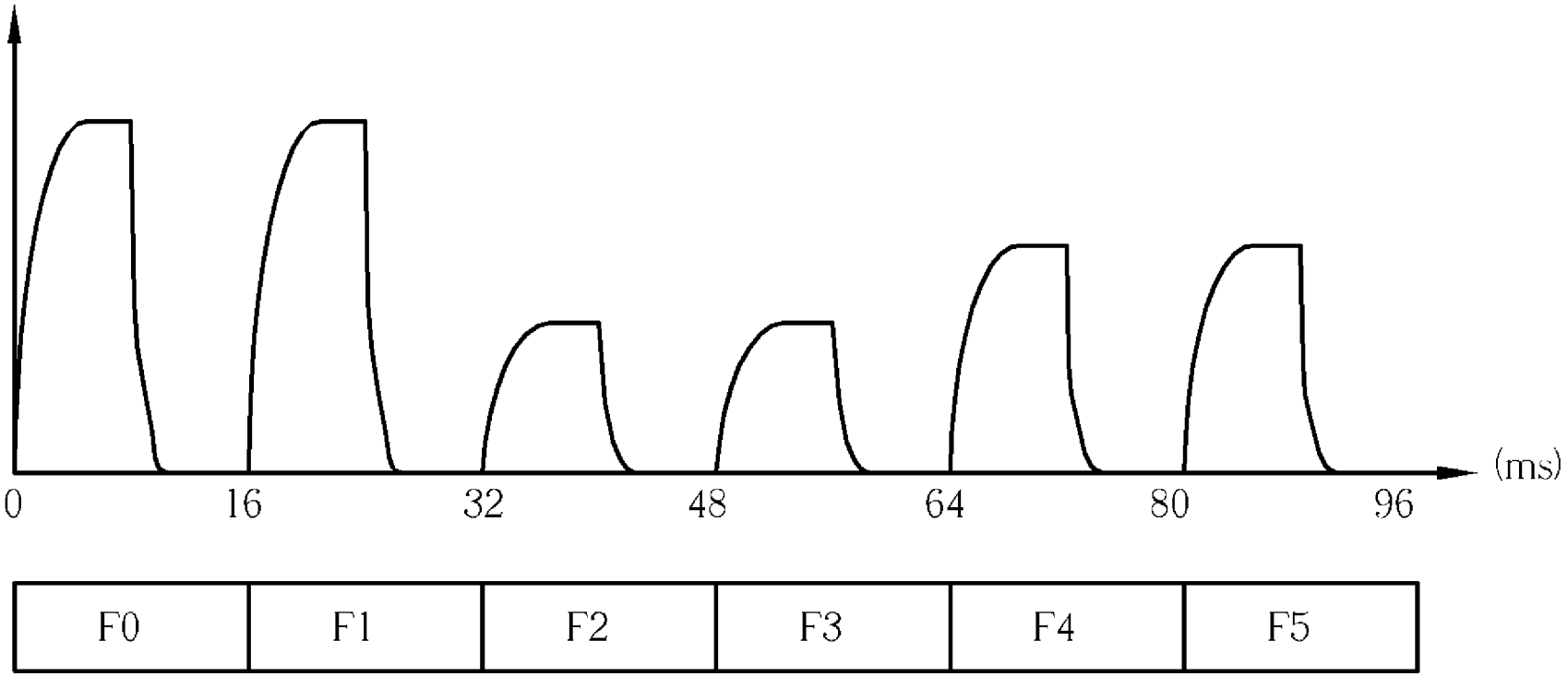
Fig. 3 Prior art
FIG. 3 is a schematic diagram of light intensity corresponding to the pixel in FIG. 2.
Figure 4:
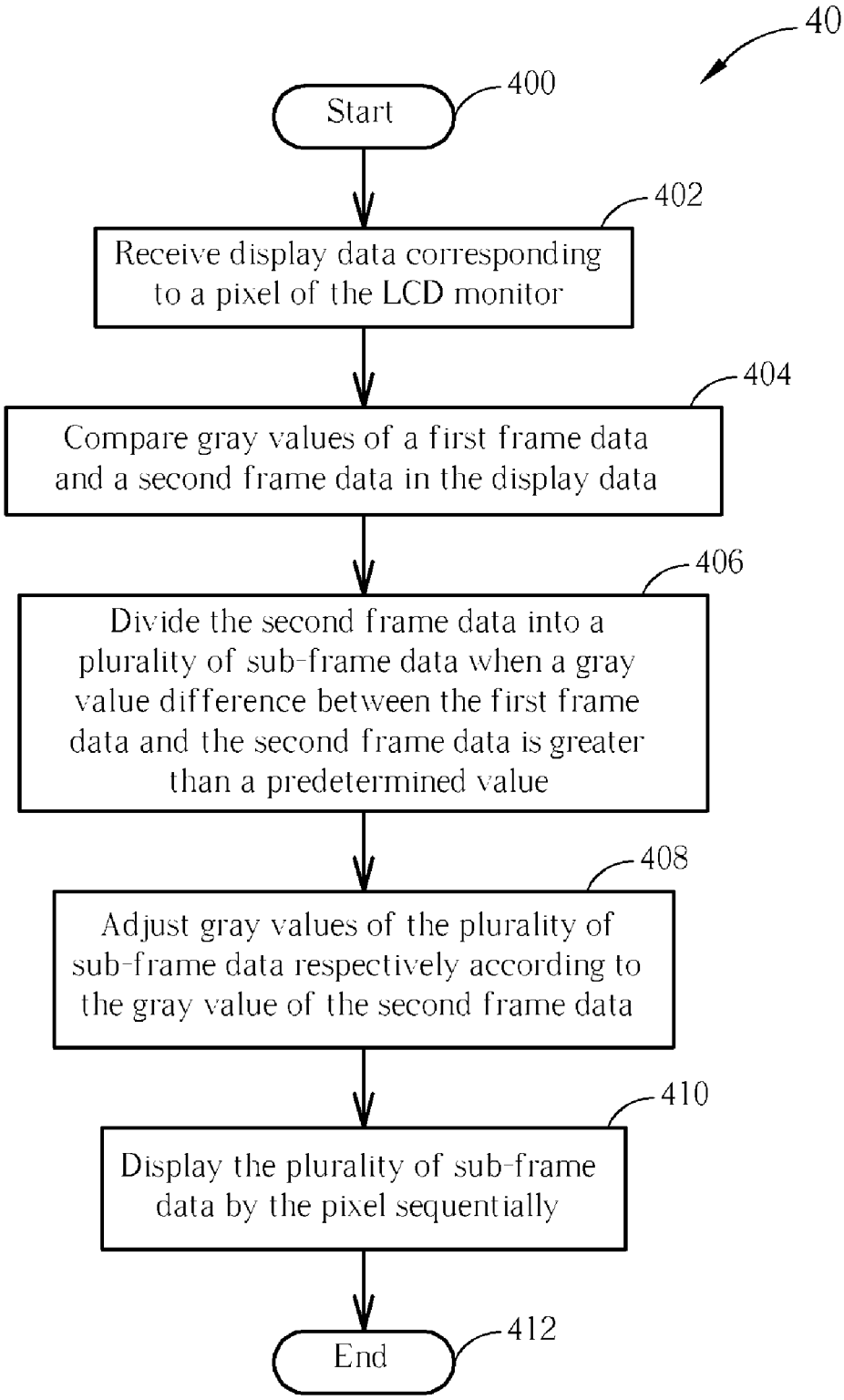
FIG. 4 is a flow chart of a process for driving an LCD monitor according to an embodiment of the present invention.

Please refer to FIG. 4, which is a flow chart of a process 40 for driving an LCD monitor according to an embodiment of the present invention. The process 40 comprises the following steps:

Step 400: Start.

Step 402: Receive display data corresponding to a pixel of the LCD monitor.

Step 404: Compare gray values of a first frame data and a second frame data in the display data.

Step 406: Divide the second frame data into a plurality of sub-frame data when a gray value difference between the first frame data and the second frame data is greater than a predetermined value.

Step 408: Adjust gray values of the plurality of sub-frame data respectively according to the gray value of the second frame data.

Step 410: Display the plurality of sub-frame data by the pixel sequentially.

Step 412: End.

According to the process 40, the present invention divides the second frame data into a plurality of sub-frame data when a gray value difference between the first frame data and the second frame data is greater than a predetermined value. Then, according to the original gray value of the second frame data, the gray values of the plurality of sub-frame data are adjusted respectively. Finally, the pixel displays the plurality of sub-frame data sequentially. Preferably, the first frame data and the second frame data are corresponding to adjacent frames, and the first frame data is prior to the second frame data. According to the original gray value of the second frame data, the step 408 adjusts the gray values of the plurality of sub-frame data respectively via methods of black insertion, pre-shoot, over-driving, etc., so as to make the average gray value of the plurality of sub-frame data approximate to the original gray value of the second frame data for keeping brightness. In addition, the present invention can further adjust durations of the plurality of sub-frame data respectively in the step 408.

Therefore, when the process 40 drives a pixel for displaying a frame data, the frame data can be divided into a plurality of sub-frame data when a gray value difference between the frame data and a prior frame data is greater than a predetermined value. Then, the gray values of the plurality of sub-frame data can be adjusted via the methods of black insertion, pre-shoot, over-drive, etc., so as to make the average gray value of the plurality of sub-frame data approximate to the original gray value of the frame data for keeping output brightness and enhancing the image quality. In other words, according to the gray value difference between the adjacent frame data, the present invention determines whether black sub-frames, sub-frames with low gray values, pre-shoot sub-frames, or over-drive sub-frames, etc. are necessary to be inserted. Certainly, the present invention can preset a plurality of threshold values corresponding to different gray value differences. For example, when a gray value difference is greater than a first threshold value, a black sub-frame or a sub-frame with a comparative low gray value is inserted, and when a gray value difference is smaller than the first threshold value and greater than a second threshold value, a pre-shoot sub-frame is inserted. In short, the present invention determines whether sub-frames are necessary to be inserted and determines the gray values of the sub-frames according to the gray value difference between adjacent frame data. In comparison, the prior art always inserts sub-frames with zero or comparative low gray values regardless of gray value differences between adjacent frames, which causes the multi-edge effect.

Because the present invention dynamically determines whether sub-frames are necessary to be inserted and gray values of the sub-frame according to gray value differences between adjacent frames, the present invention can eliminate not only the motion blur phenomenon, but also the multi-edge effect. For example, if a movie shows a bright subject moving in a dark background, the present invention can eliminate the motion blur problem in the rear edge of the moving subject by inserting a black sub-frame or a sub-frame with a comparative low gray value, and prevent the multi-edge effect in the front edge of the moving subject via the methods of pre-shoot or over-driving (not inserting a black sub-frame). Similarly, if a movie shows a dark subject moving in a bright background, the present invention can eliminate the motion blur problem in the front edge of the moving subject by inserting a black sub-frame or a sub-frame with a comparative low gray value, and prevent from the multi-edge effect in the rear edge of the moving subject via the methods of pre-shoot or over-driving (not inserting a black sub-frame).

Figure 5:
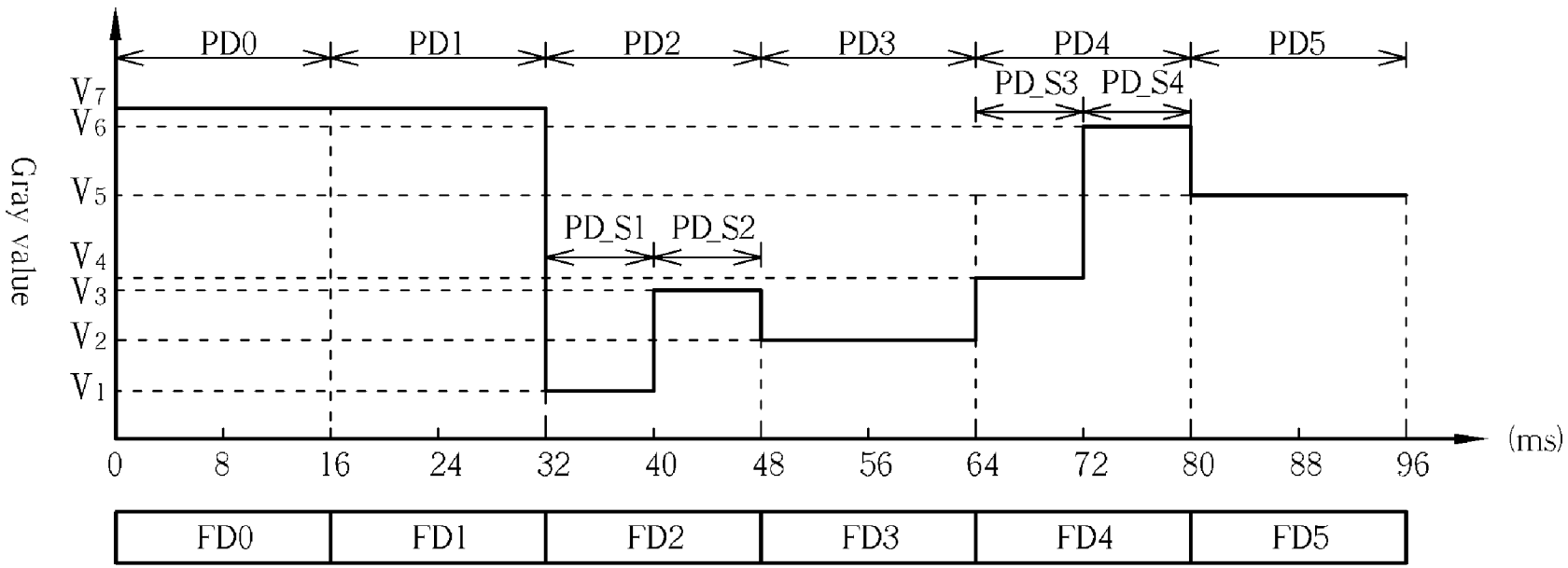
FIG. 5 is a schematic diagram of an embodiment when outputting driving data to a pixel according to the process shown in FIG. 4.
Figure 6:
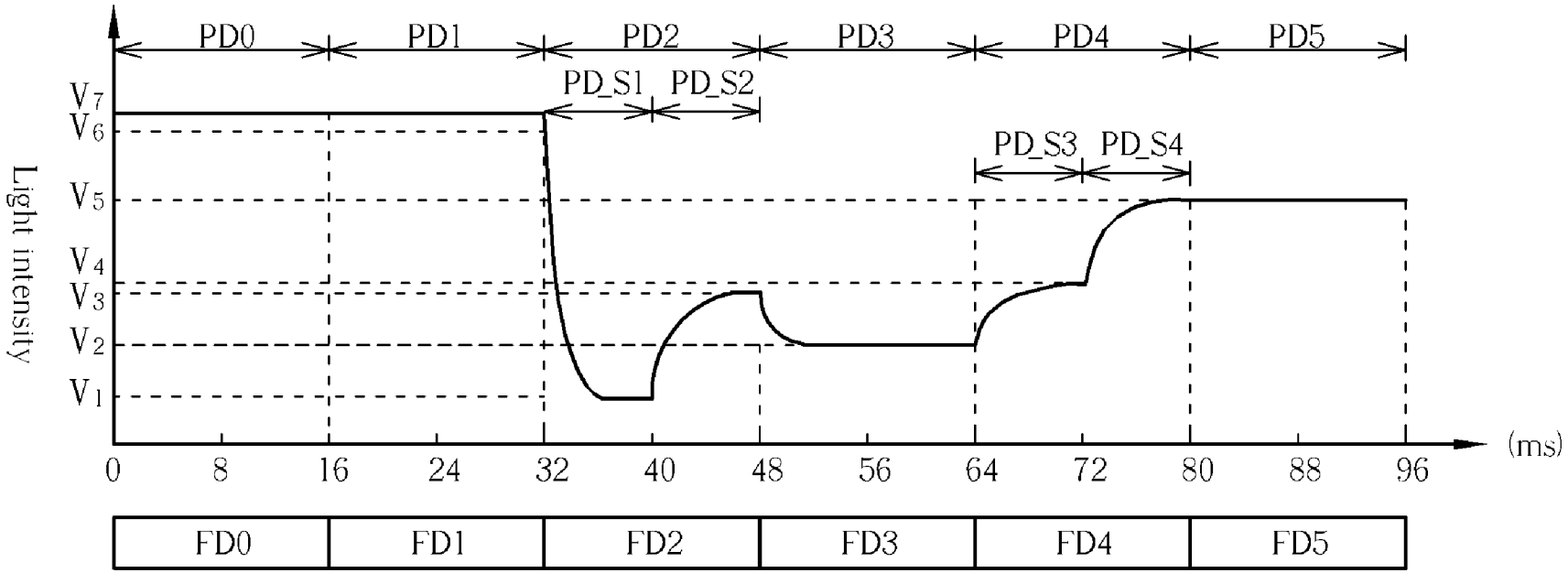
FIG. 6 is a schematic diagram of light intensity corresponding to FIG. 5.

For example, please refer to FIG. 5 and FIG. 6. FIG. 5 illustrates a schematic diagram of an embodiment when outputting driving data to a pixel according to the process 40, while FIG. 6 is a schematic diagram of light intensity generated by the pixel. In FIG. 5, an x-axis represents time, and a y-axis represents gray values of frame data PD0, PD1, PD2, etc. corresponding to frames FD0, FD1, FD2, etc. As shown in FIG. 5, gray values of the frame data PD0 and PD1 are V7, meaning that there is no gray value difference between the frame data PD0 and PD1. Thus, the frame data PD1 is not divided. Following the frame data PD1, a gray value difference between the frame data PD1 and PD2 (|V2−V7|) is greater than a predetermined value TH1, so that the present invention divides the frame data PD2 into two sub-frame data PD_S1 and PD_S2 with gray values V1 and V3 respectively. In other words, because the gray value difference between the frame data PD1 and PD2 is greater than the predetermined value TH1, and the image displayed by the pixel varies from bright to dark, the gray value of the sub-frame data PD_S1 is set as V1 (V1 is smaller than V2), so as to rapidly change luminance from bright to dark. Meanwhile, the gray value of the sub-frame data PD_S2 is set as V3 (V3 is greater than V2) to compensate gray value loss of the frame data PD2. Next, gray values of the frame data PD2 and PD3 are V2, meaning that there is no gray value difference between the frame data PD2 and PD3. Thus, the frame data PD3 is not divided. Because a gray value difference between the frame data PD3 and PD4 (|V2−V5|) is greater than a predetermined value TH2, the present invention divides the frame data PD4 into two sub-frame data PD_S3 and PD_S4 with gray values V4 and V6 respectively. In other words, because the gray value difference between the frame data PD3 and PD4 is greater than the predetermined value TH2, and the image displayed by the pixel varies from dark to bright, the gray value of the sub-frame data PD_S3 is set as V4 (V4 is smaller than V5), so to make liquid crystal molecules response in advance by the pre-shoot method. Meanwhile, the gray value of the sub-frame data PD_S4 is set as V6 (V6 is greater than V5) through the over-driving method for accelerating the liquid crystal molecules to rapidly achieve a target gray value of the pixel.

Therefore, as shown in FIG. 5, the present invention determines whether the sub-frames are necessary to be inserted and adjusts the gray values of the inserted sub-frames according to the gray value differences between the adjacent frame data. Thus the present invention can solve not only the motion blur problem but also the multi-edge effect. In FIG. 6, the frames FD1 to FD2 represent the image varying from light to dark immediately, and because the gray value of the sub-frame data PD_S1 is smaller than that of the sub-frame data PD_S2, which performs like the impulse response, the motion blur problem can be eliminated. The frames FD3 to FD4 represent the image varying from dark to light immediately, and the pixel can rapidly achieve the target gray value by pre-shooting of the sub-frame data PD_S3 and over-driving of the sub-frame data PD_S4.

Figure 7:
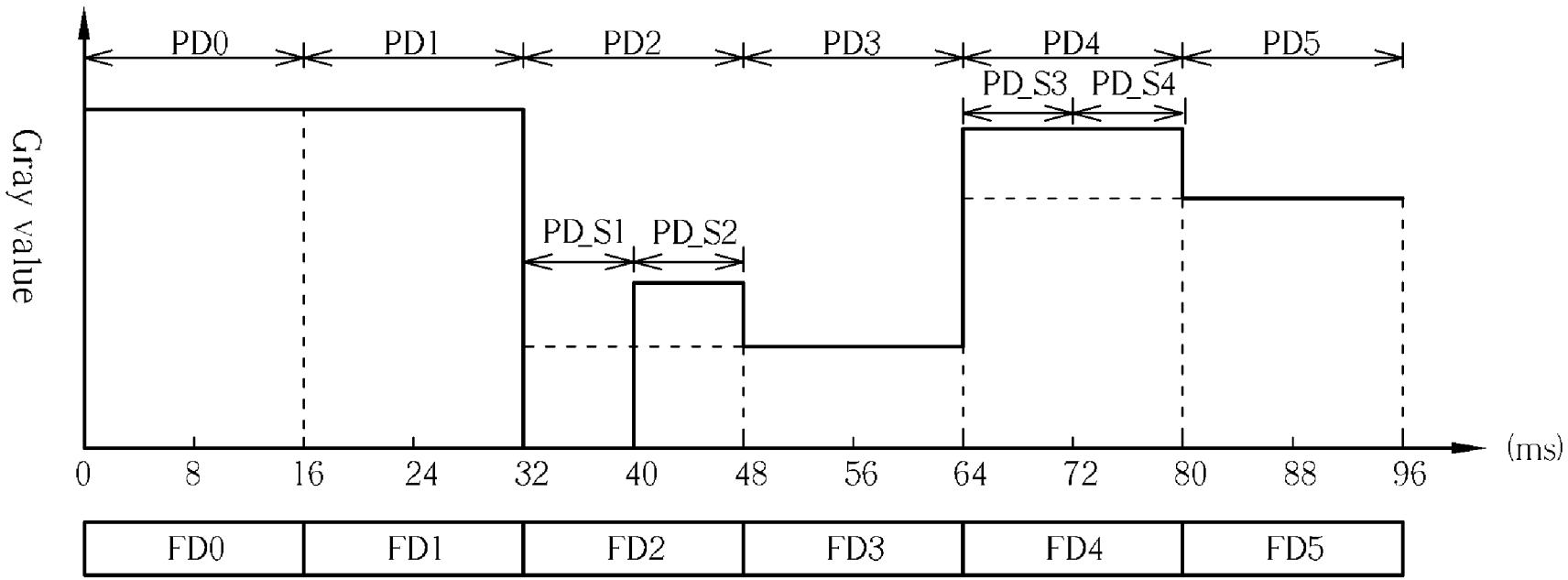
FIG. 7 is a schematic diagram of an embodiment when outputting driving data to a pixel according to the process shown in FIG. 4.
Figure 8:
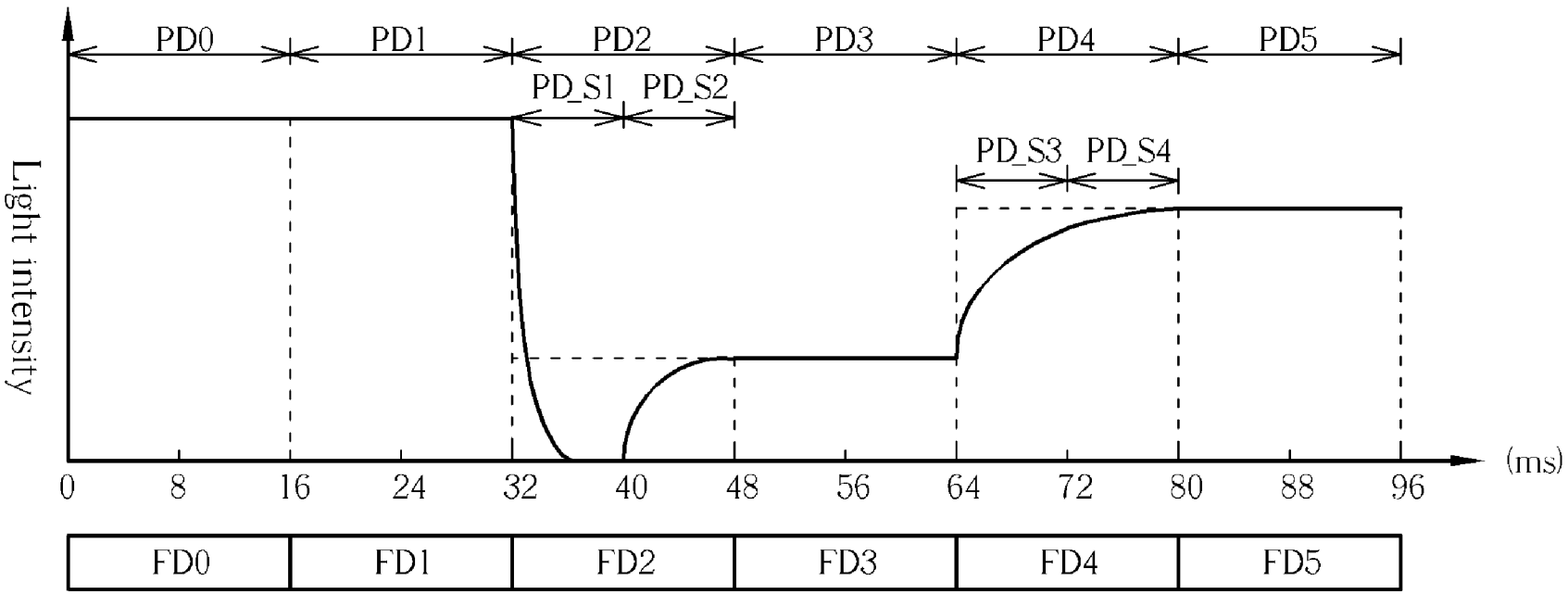
FIG. 8 is a schematic diagram of light intensity corresponding to FIG. 7.

Comparing the gray values of adjacent frame data, the present invention determines whether the sub-frames are necessary to be inserted and determines the gray values of the sub-frame data. Certainly, those skilled in the art can make modifications according to different system requirements. For example, please refer to FIG. 7 and FIG. 8. FIG. 7 illustrates a schematic diagram of an embodiment when outputting driving data to a pixel according to the process 40, while and FIG. 8 is a schematic diagram of light intensity generated by the pixel. The differences between the embodiments of FIG. 7 and FIG. 5 are that a gray value of the sub-frame data PD_S1 shown in FIG. 7 is zero, and both of the sub-frame data PD_S3 and PD_S4 are performed over-driving.

Figure 9:
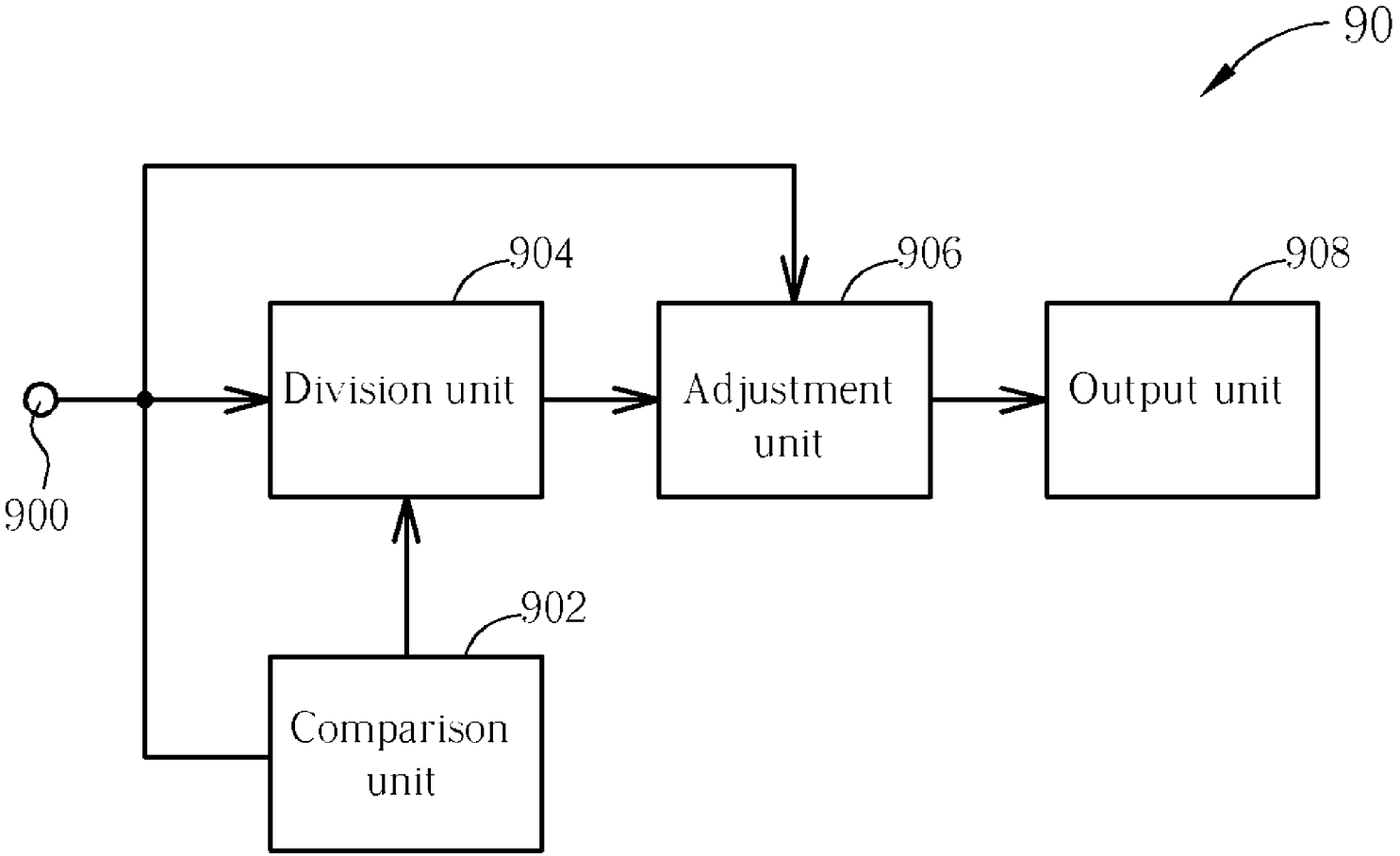
FIG. 9 is a functional block diagram of a pixel driving device of an LCD monitor according to an embodiment of the present invention.

As to implementation of the process 40, please refer to FIG. 9. FIG. 9 is a functional block diagram of a pixel driving device 90 of an LCD monitor according to an embodiment of the present invention. The pixel driving device 90 is utilized for realizing the process 40, and comprises a reception end 900, a comparison unit 902, a division unit 904, an adjustment unit 906, and an output unit 908. The reception end 900 receives display data corresponding to a pixel of the LCD monitor. The comparison unit 902 is coupled to the reception end 900, and is utilized for comparing gray values of a first frame data and a second frame data in the display data. The division unit 904 is coupled to the comparison unit 902 and the reception end 900, and is utilized for dividing the second frame data into a plurality of sub-frame data when a gray value difference between the first frame data and the second frame data is greater than a predetermined value. The adjustment unit 906 is coupled to the division unit 904 and the reception end 900, and is utilized for adjusting gray values of the plurality of sub-frame data respectively according to the gray value of the second frame data. The output unit 908 is coupled to the adjustment unit 906, and is utilized for displaying the plurality of sub-frame data by the pixel sequentially.

Therefore, according to a comparison result of the comparison unit 902, the division unit 904 can divide the second frame data into a plurality of sub-frame data when the gray value difference between the first frame data and the second frame data is greater than a predetermined value. Then, according to an original gray value of the second frame data, the adjustment unit 906 adjusts gray values of the plurality of sub-frame data respectively. Finally, the output unit 908 displays the plurality of sub-frame data via the pixel sequentially. Preferably, the first frame data and the second frame data are corresponding to adjacent frame data, and the first frame data is prior to the second frame data. According to the original gray value of the second frame data, the adjustment unit 906 can adjust gray values of the plurality of sub-frame data respectively through methods of black insertion, pre-shoot, and over-driving, etc., so as to make the average gray value of the plurality of the sub-frame data approximate to the original gray value of the second frame data for keeping brightness. In addition, the adjustment unit 906 can further comprise a timing adjustment unit for adjusting durations of the plurality of the sub-frame data respectively.

Therefore, when the pixel driving device 90 drives a pixel to display frame data, the division unit 904 can divide the frame data into a plurality of sub-frame data if a gray value difference between the frame data and a prior frame data is greater than a predetermined value. Moreover, the adjustment unit 906 can adjust gray values of the plurality of sub-frame data through methods of black insertion, pre-shoot, and over-driving, etc., so as to make the average gray value of the plurality of sub-frame data approximate to an original gray value of the frame data for keeping brightness and enhancing the image quality.

Note that, the pixel driving device 90 shown in FIG. 9 is utilized for realizing the process 40. Certainly, those skilled in the art can design other pixel driving devices corresponding to different system requirements according to the process 40.

Figure 10:
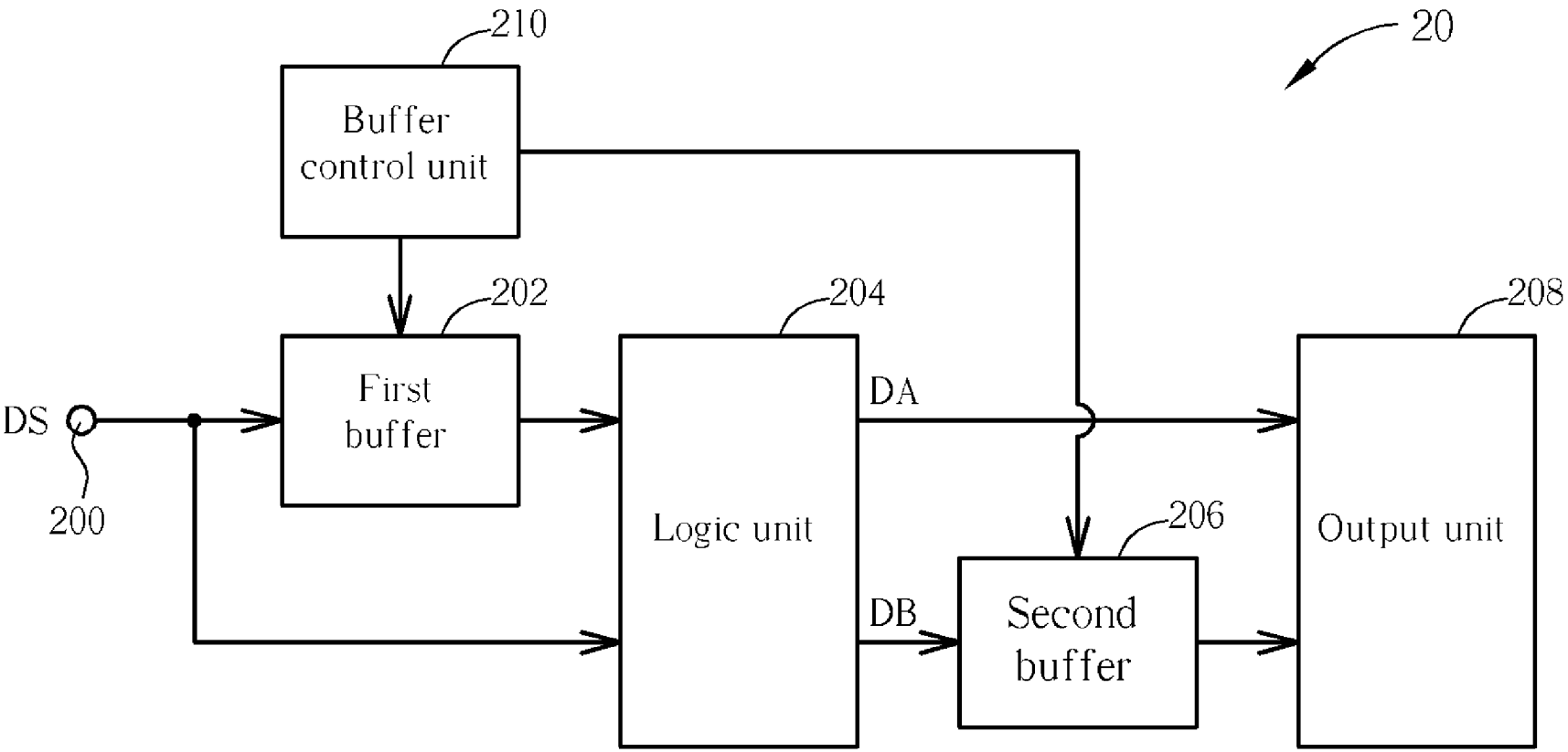
FIG. 10 is a functional block diagram of a pixel driving device of an LCD monitor according to an embodiment of the present invention.

For example, please refer to FIG. 10. FIG. 10 is a functional block diagram of a pixel driving device 20 of an LCD monitor according to an embodiment of the present invention. The pixel driving device 20 comprises a reception end 200, a first buffer 202, a logic unit 204, a second buffer 206, an output unit 208, and a buffer control unit 210. The reception end 200 is utilized for receiving display data DS corresponding to a pixel of the LCD monitor. The first buffer 202 is coupled to the reception end 200, and is utilized for storing a first frame data in the display data DS. The logic unit 204 is coupled to the first buffer 202 and the reception end 200, and is utilized for generating a first sub-frame data DA and a second sub-frame data DB according to a gray value difference between the first frame data and a second frame data in the display data DS. A data size of each of the first sub-frame data DA and the second sub-frame data DB is half a size of the second frame data. The second buffer 206 is coupled to the logic unit 204, and is utilized for storing the second sub-frame data DB. The output unit 208 is coupled to the logic unit 204 and the second buffer 206, and is utilized for displaying the first sub-frame data DA and the second sub-frame data DB sequentially. The buffer control unit 210 is coupled to the first buffer 202 and the second buffer 206, and is utilized for controlling the first buffer 202 and the second buffer 206. Preferably, the first frame data and the second frame data are corresponding to adjacent frame data, and the first frame data is prior to the second frame data. In other words, the logic unit 204 outputs the first sub-frame data DA and the second sub-frame data DB by comparing the gray values of the adjacent frame data. Then, the second buffer 206 temporarily stores the second sub-frame data DB for delaying the second sub-frame data DB for half a frame duration. Finally, the output unit 208 can output the first sub-frame data DA and the second sub-frame data sequentially.

In short, in the pixel driving device 20, the logic unit 204 generates the first sub-frame data DA and the second sub-frame data DB according to the gray value difference between the first frame data and the second frame data. For example, when the gray value difference between the first frame data and the second frame data is small, the gray values of the first sub-frame data DA and the second sub-frame data DB can be set equivalent to the second frame data. When the gray value difference between the first frame data and the second frame data is greater than a predetermined value, the gray values of the first sub-frame data DA and the second sub-frame data DB can be adjusted via methods of black insertion, pre-shoot, over-driving, etc., so as to make an average gray value of the first sub-frame data DA and the second sub-frame data DB approximate to an original gray value of the second frame data. Therefore, if luminance of an image is changed from light to dark, the logic unit 204 can decrease the gray value of the first sub-frame DA to zero or a comparative low value to reduce the motion blur phenomenon, and increase the gray value of the second sub-frame data DB to compensate lost brightness. Oppositely, If luminance of an image is changed from dark to light, the logic unit 204 can set the gray value of the first sub-frame data DA to a pre-shoot value and the gray value of the second sub-frame data DB to an over-driving value for accelerating time to reach a target gray value.

As to implementation of the pixel driving device 20, there is no limitation as long as functions mentioned above are satisfied. For example, the logic unit 204 can be realized by a system chip or a calculation unit with a look-up table. In addition, the logic unit 204 can further includes a timing adjustment unit for adjusting durations of the first sub-frame data DA and the second sub-frame data DB.

Figure 11:
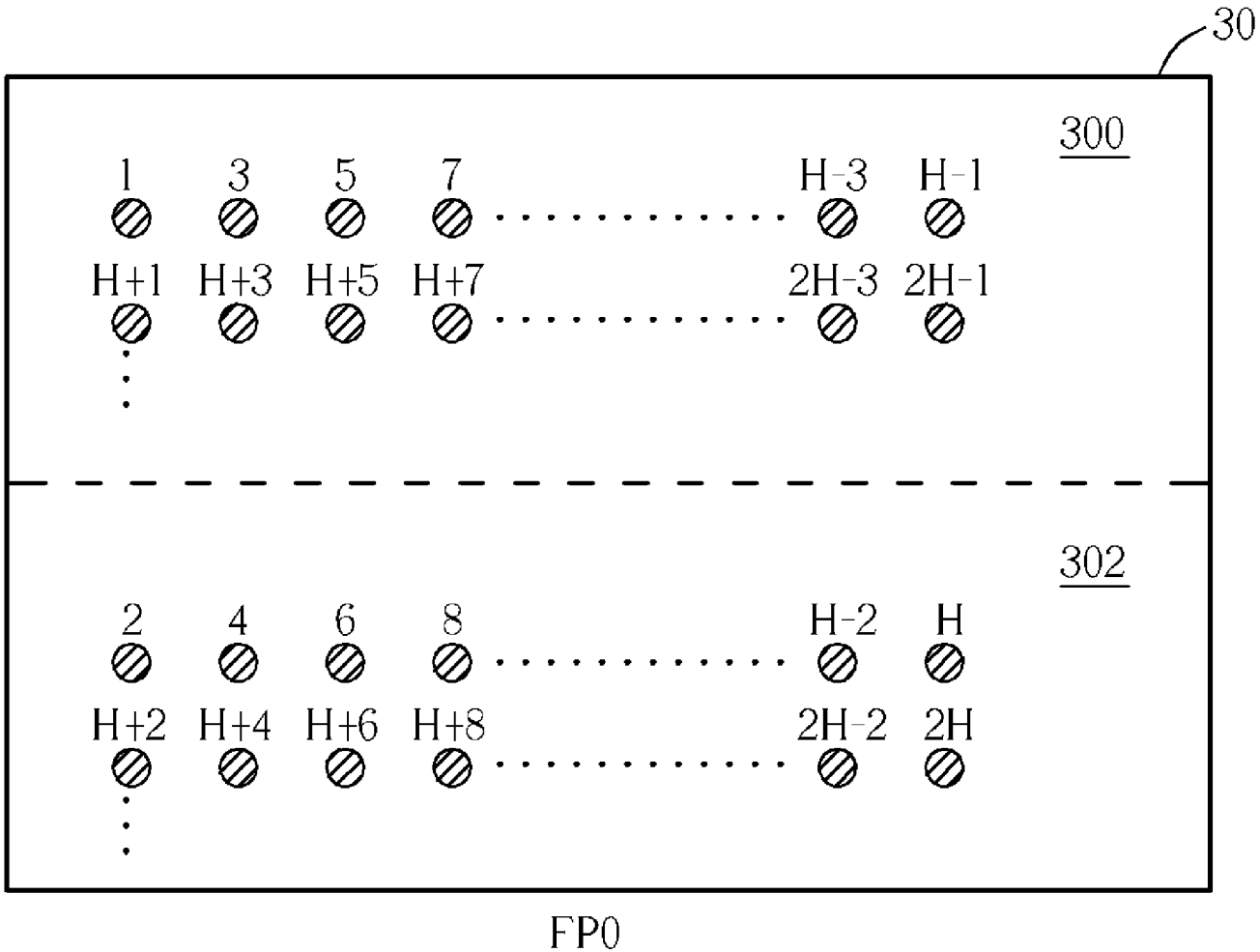
FIG. 11, FIG. 12 are schematic diagrams of scanning sequence of successive images of a panel divided into a top part and a bottom part.
Figure 12:
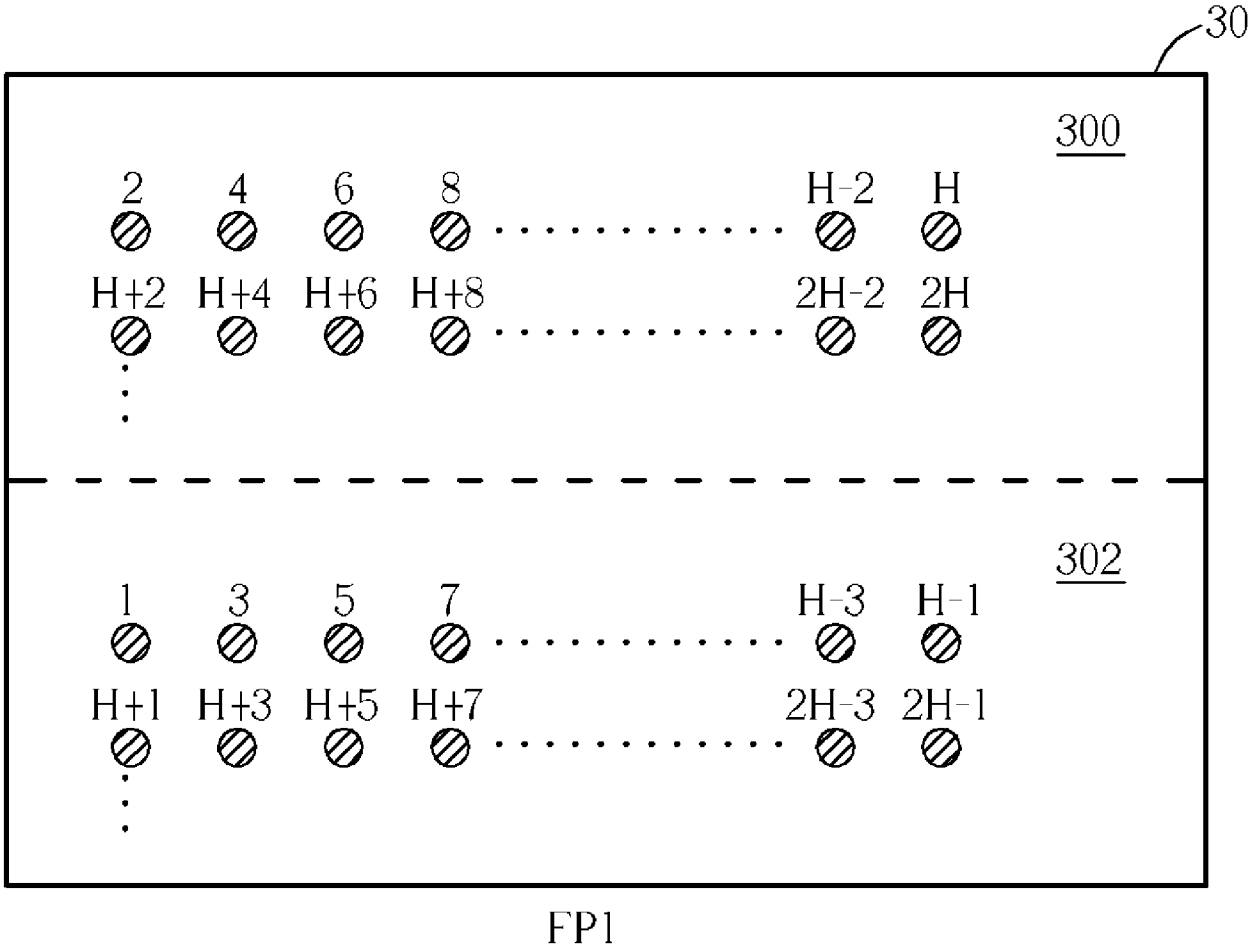
Figure 13:
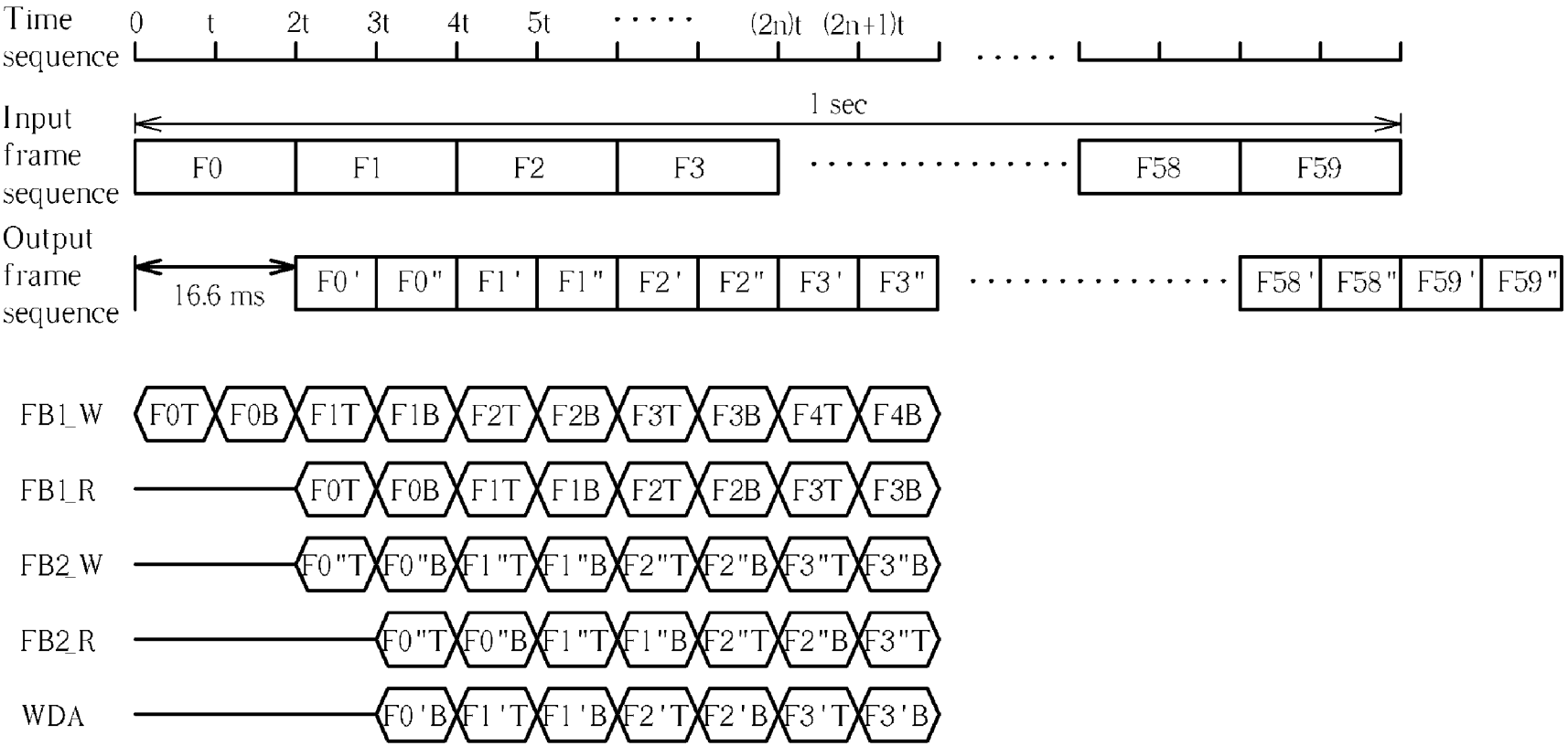
FIG. 13 is a schematic diagram of an input frame sequence, an output frame sequence, and sequences of related data corresponding to a pixel driving device at a frame rate of 60 Hz.

In addition, the first buffer 202 and the second buffer 206 are utilized for storing the first frame data and the second sub-frame data DB respectively. Therefore, storage sizes of the first buffer 202 and the second buffer 206 must conform to data size of a frame data. Since a data size of the second sub-frame data DB is half a data size of the second frame data, for saving system resources, an image can be divided into a top and a bottom parts and be scanned sequentially. As a result, the storage size of the second buffer 206 can be decreased to half the storage size of the first buffer 202. The detailed description is stated as follows. Firstly, please refer to FIG. 11 and FIG. 12, FIG. 11 and FIG. 12 illustrate schematic diagrams of a scanning sequence of successive images FP0 and FP1 of a panel 30, which is divided into a top part 300 and a bottom part 302. In FIG. 11 and FIG. 12, numbers 1 to 2H represent the scanning sequence. For each of the top part 300 and the bottom part 302, pixels are scanned one by one along the horizontal and vertical sequentially, while pixels corresponding to the same coordinates in the top part 300 and the bottom part 302 are scanned interlacedly. In such circumstance, operations of the pixel driving device 20 are illustrated in FIG. 13. FIG. 13 illustrates a schematic diagram of an input frame sequence, an output frame sequence, and sequences of related data corresponding to the pixel driving device 20 at a frame rate of 60 Hz. A pattern FB1_W represents data received by the first buffer 202, a pattern FB1_R represents data outputted from the first buffer 202, a pattern FB2_W represents data received by the second buffer 206, a pattern FB2_R represents data outputted from the second buffer 206, and a pattern WDA represents the data outputted from the logic unit 204 to the output unit 208. In addition, data F0T represents data corresponding to the top part 300 in the frame F0, data FOB represents data corresponding to the bottom part 302 in the frame F0, and so on. As shown in FIG. 13, the first buffer 202 stores the whole frame data, and the second buffer 206 only stores half the frame data. In this case, the total storage size of the first buffer 202 and the second buffer 206 is 1.5 times a data size of the frame data, so that the system resource can be saved.

As mentioned above, since liquid crystal molecules perform as a capacitor, the liquid crystal molecules have a problem of slow response rate. Moreover, compared with the impulse-type driving method of the CRT displays, the hold-type driving method of the LCD displays causes the motion blur phenomenon on image edges of moving subjects. The prior art black insertion technique, inserting sub-frames with zero gray value or a comparative low gray value, improves the motion blur phenomenon, but loses average brightness and image quality. Furthermore, owing to the limitation of the liquid crystal molecules, the liquid crystal molecules take much time to reach a target gray value as the gray value varies, which cause the multi-edge effect on parts of image edges of a moving subject. In comparison, when driving pixels for displaying a frame data, the present invention determines whether sub-frames are necessary to be inserted and adjusts the gray values of the sub-frame data through methods of black insertion, pre-shoot, and over-driving, etc. according to gray value differences between adjacent frame data, so as to make an average gray value of the sub-frame data approximate to an original gray value for keeping brightness and enhancing image quality. As a result, the present invention can not only reduce the motion blur problem and the multi-edge effect, but also keep brightness and enhance image quality.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for driving a liquid crystal display (LCD) monitor comprising:

receiving display data corresponding to a pixel of the LCD monitor;

comparing gray values of a first frame data and a second frame data in the display data;

dividing the second frame data into a plurality of sub-frame data when a gray value difference between the first frame data and the second frame data is greater than a predetermined value;

adjusting gray values of the plurality of sub-frame data respectively according to the gray value of the second frame data; and displaying the plurality of sub-frame data by the pixel sequentially.

2. The method of claim 1, wherein the first frame data and the second frame data are corresponding to adjacent frames.

3. The method of claim 1, wherein the first frame data is prior to the second frame data.

4. The method of claim 1, wherein the second frame data is divided into two sub-frame data when the gray value difference between the first frame data and the second frame data is greater than the predetermined value.

5. The method of claim 1, wherein adjusting the gray values of the plurality of sub-frame data respectively according to the gray value of the second frame data is adjusting the gray values of the plurality of sub-frame data respectively according to the gray value of the second frame data, so as to make an average gray value of the plurality of sub-frame data approximate to the gray value of the second frame data.

6. The method of claim 1, wherein adjusting the gray values of the plurality of sub-frame data respectively according to the gray value of the second frame data comprises adjusting durations of the plurality of sub-frame data respectively.

7. The method of claim 1, wherein adjusting the gray values of the plurality of sub-frame data respectively according to the gray value of the second frame data comprises adjusting a gray value of a first sub-frame data of the plurality of sub-frame data to be smaller than the gray value of the second frame data.

8. The method of claim 7 further comprising adjusting a gray value of one of the plurality of sub-frame data to make an average gray value of the sub-frame data and the first sub-frame data approximate to the gray value of the second frame data.

9. The method of claim 1, wherein adjusting the gray values of the plurality of sub-frame data respectively according to the gray value of the second frame data comprises adjusting a gray value of a first sub-frame data of the plurality of sub-frame data to be greater than the gray value of the second frame data according to the gray value of the second frame data.

10. A pixel driving device of a liquid crystal display (LCD) monitor comprising:

a reception end for receiving display data corresponding to a pixel of the LCD monitor;

a comparison unit coupled to the reception end for comparing gray values of a first frame data and a second frame data in the display data;

a division unit coupled to the comparison unit and the reception end for dividing the second frame data into a plurality of sub-frame data when a gray value difference between the first frame data and the second frame data is greater than a predetermined value;

an adjustment unit coupled to the division unit and the reception end for adjusting gray values of the plurality of sub-frame data respectively according to the gray value of the second frame data; and an output unit coupled to the adjustment unit for displaying the plurality of sub-frame data with the pixel sequentially.

11. The pixel driving device of claim 10, wherein the first frame data and the second frame data are corresponding to adjacent frames.

12. The pixel driving device of claim 10, wherein the first frame data is prior to the second frame data.

13. The pixel driving device of claim 10, wherein the division unit is utilized for dividing the second frame data into two sub-frame data when the gray value difference between the first frame data and the second frame data is greater than the predetermined value.

14. The pixel driving device of claim 10, wherein the adjustment unit is utilized for adjusting the gray values of the plurality of sub-frame data respectively according to the gray value of the second frame data, so as to make an average gray value of the plurality of sub-frame data approximate to the gray value of the second frame data.

15. The pixel driving device of claim 10, wherein the adjustment unit comprises a timing adjustment unit for adjusting durations of the plurality of sub-frame data respectively.

16. The pixel driving device of claim 10, wherein the adjustment unit is utilized for adjusting a gray value of a first sub-frame data of the plurality of sub-frame data to be smaller than the gray value of the second frame data.

17. The pixel driving device of claim 16, wherein the adjustment unit is further utilized for adjusting a gray value of one of the plurality of sub-frame data to make an average gray value of the sub-frame data and the first sub-frame data approximate to the gray value of the second frame data.

18. The pixel driving device of claim 10, wherein the adjustment unit is utilized for adjusting a gray value of a first sub-frame data of the plurality of sub-frame data to be greater than the gray value of the second frame data according to the gray value of the second frame data.

* * * * *